US006503064B1

(12) United States Patent
Croke et al.

(10) Patent No.: US 6,503,064 B1
(45) Date of Patent: Jan. 7, 2003

(54) BI-DIRECTIONAL LOW MAINTENANCE VANE PUMP

(75) Inventors: Steven B. Croke, Clinton; Scott P. Shafer, New Hartford, both of NY (US)

(73) Assignee: Lucas Aerospace Power Transmission, Utica, NY (US)

( * ) Notice: Subject to any disclaimer, the term of this patent is extended or adjusted under 35 U.S.C. 154(b) by 0 days.

(21) Appl. No.: 09/354,619

(22) Filed: Jul. 15, 1999

(51) Int. Cl.[7] ..... F04B 17/00

(52) U.S. Cl. ..... 417/326; 417/410.3; 418/133; 418/259

(58) Field of Search ..... 417/410.3, 326; 418/259, 131, 133, 102

(56) References Cited

U.S. PATENT DOCUMENTS

| | | | | |
|---|---|---|---|---|
| 2,809,593 A | * | 10/1957 | Klessig et al. | 418/133 |
| 3,204,565 A | | 9/1965 | Kirkpatrick | |
| 3,279,387 A | | 10/1966 | McGill | |
| 3,829,924 A | * | 8/1974 | Bright et al. | 417/410.3 |
| 4,035,115 A | | 7/1977 | Hansen | |
| 4,204,810 A | | 5/1980 | Vogel | |
| 4,376,620 A | | 3/1983 | Colston | |
| 4,384,828 A | | 5/1983 | Rembold et al. | |
| 4,484,868 A | | 11/1984 | Shibuya et al. | |
| 4,516,918 A | | 5/1985 | Drutchas et al. | |
| 4,566,869 A | * | 1/1986 | Pandeya et al. | 418/259 |
| 4,578,948 A | | 4/1986 | Hutson et al. | 418/30 |
| 4,656,099 A | * | 4/1987 | Sievers | 428/610 |
| 4,770,612 A | | 9/1988 | Tuebler | |
| 4,902,209 A | | 2/1990 | Olson | |
| 5,064,362 A | | 11/1991 | Hansen | |
| 5,083,909 A | | 1/1992 | Kunsemiller et al. | 418/102 |
| 5,154,593 A | | 10/1992 | Konishi et al. | 418/77 |
| 5,183,392 A | | 2/1993 | Hansen | |
| 5,407,327 A | | 4/1995 | Felhmann | |
| 5,496,159 A | | 3/1996 | Devore | |
| 5,513,960 A | | 5/1996 | Uemoto | |
| 5,556,270 A | | 9/1996 | Komine et al. | |
| 5,654,107 A | | 8/1997 | Tanaka et al. | |
| 5,658,137 A | | 8/1997 | Makela | |
| 5,672,054 A | | 9/1997 | Cooper et al. | |

FOREIGN PATENT DOCUMENTS

| | | | | |
|---|---|---|---|---|
| JP | 59168291 A | * | 9/1984 | 418/131 |
| JP | 59180088 A | * | 10/1984 | 418/133 |

* cited by examiner

*Primary Examiner*—Cheryl J. Tyler
(74) *Attorney, Agent, or Firm*—Stephen B. Salai, Esq.; Brian B. Shaw, Esq.; Harter, Secrest & Emery LLP

(57) ABSTRACT

A long-life, low maintenance, bi-directional vane-type water pump has a high degree of symmetry and operates with equal efficiency in either direction. The axial position of the drive shaft is controlled to permit improved lubrication by the pumping fluid of component parts on which the drive shaft is journaled.

6 Claims, 4 Drawing Sheets

BI-DIRECTIONAL LOW MAINTENANCE VANE PUMP

FIELD OF THE INVENTION

The present invention relates generally to a fluid pressure energy translating device of the vane type that is suitable for applications such as pumping water in space applications and employs water as the lubricating fluid.

BACKGROUND OF THE INVENTION

The design of a vane pump for pumping fresh water in space applications presents a serious challenge to the designer because of requirements of light weight and infrequent maintenance. Also, when pumping water it is desirable for the pump to be self-lubricating, i.e., to use the pumped fluid itself as a lubricant. The poor lubricity and low viscosity of water compared with lubricating oils contributes to the challenge. The low viscosity dictates that all design clearances must be an order of magnitude less than for oil lubricated devices. In addition, the potential contamination of scarce water in a space vehicle requires that no oils or greases be used. A high pumping efficiency is clearly advantageous, since a given pumping rate is achievable with the minimum expenditure of power.

Generally, vane devices comprise a circular rotor disposed within a non circular cam ring, so that the gap between the rotor and the cam ring varies according to the angular position within the ring. Vanes are disposed in openings around the periphery of the rotor, and when in motion, make sliding contact with the inside of the cam ring. The vanes are free to move back and forth in the openings, being urged into continuous contact with the cam ring by centrifugal force, springs or hydraulic pressure. As the vanes move around the cam ring, they displace fluid into zones of increasing volume, causing more fluid to enter from an inlet port, or into zones of decreasing volume, from which fluid is discharged through an outlet port.

Various examples of vane pumps have been disclosed previously. While various examples of pumps perform satisfactorily for their intended purposes, certain limitations prevent them from performing satisfactorily as water pumps in space environments. In particular, space applications demand that pump weight be minimized and that the pump provide efficient trouble-free operation for extremely long periods with minimal maintenance.

SUMMARY OF THE INVENTION

The invention disclosed herein describes a bi-directional, self-lubricating vane-type water pump. The pump comprises a rotor with a plurality of radial slots, each of which accommodates a vane. The rotor and vanes are driven by a drive shaft to revolve within a non-circular cam ring, displacing fluid and causing it to enter through an inlet port, or to be discharged through an outlet port, the ports being present in port plates. In this invention, the port plates and the cam ring are disposed in a highly symmetrical fashion, which promotes efficiency and furthermore provides equally efficient operation of the pump in either direction. Within narrow prescribed limits, the drive shaft of the pump is free to float back and forth along its axis. This axial movement may be controlled through a shim washer placed at the end the drive shaft. This provides optimum efficiency, permitting sufficient clearance between components to avoid binding and allow the pumping fluid, for example water, to lubricate where required, but nevertheless preventing excessive play. The fluid flows in the pump are subject to minimal constriction, which also contributes to efficient operation. Additionally, wear resistant and friction resistant materials may be employed for specific component parts, so as to obviate the need for conventional bearings. The pump requires very little maintenance, and is suitable for installation in remote locations such as space.

Accordingly, it is an object of this invention to provide an improved pump for fluids of low viscosity which has an extremely long operating lifetime with minimal maintenance and is suitable for space applications.

It is further an object of this invention to provide an improved pump for fluids of low viscosity which has a simple design, such that fluid flows are minimally constricted, providing optimal efficiency.

It is further an object of this invention to provide an improved bi-directional pump for fluids of low viscosity which has a high internal symmetry, allowing effectively equal efficiency in either direction.

It is further an object of this invention to provide a pump requiring minimal maintenance via the elimination of dynamic seals.

Finally, it is an object of this invention to provide an improved pump for fluids of low viscosity which is self lubricating.

DETAILED DESCRIPTION OF THE PREFERRED EMBODIMENT

Figure 1:
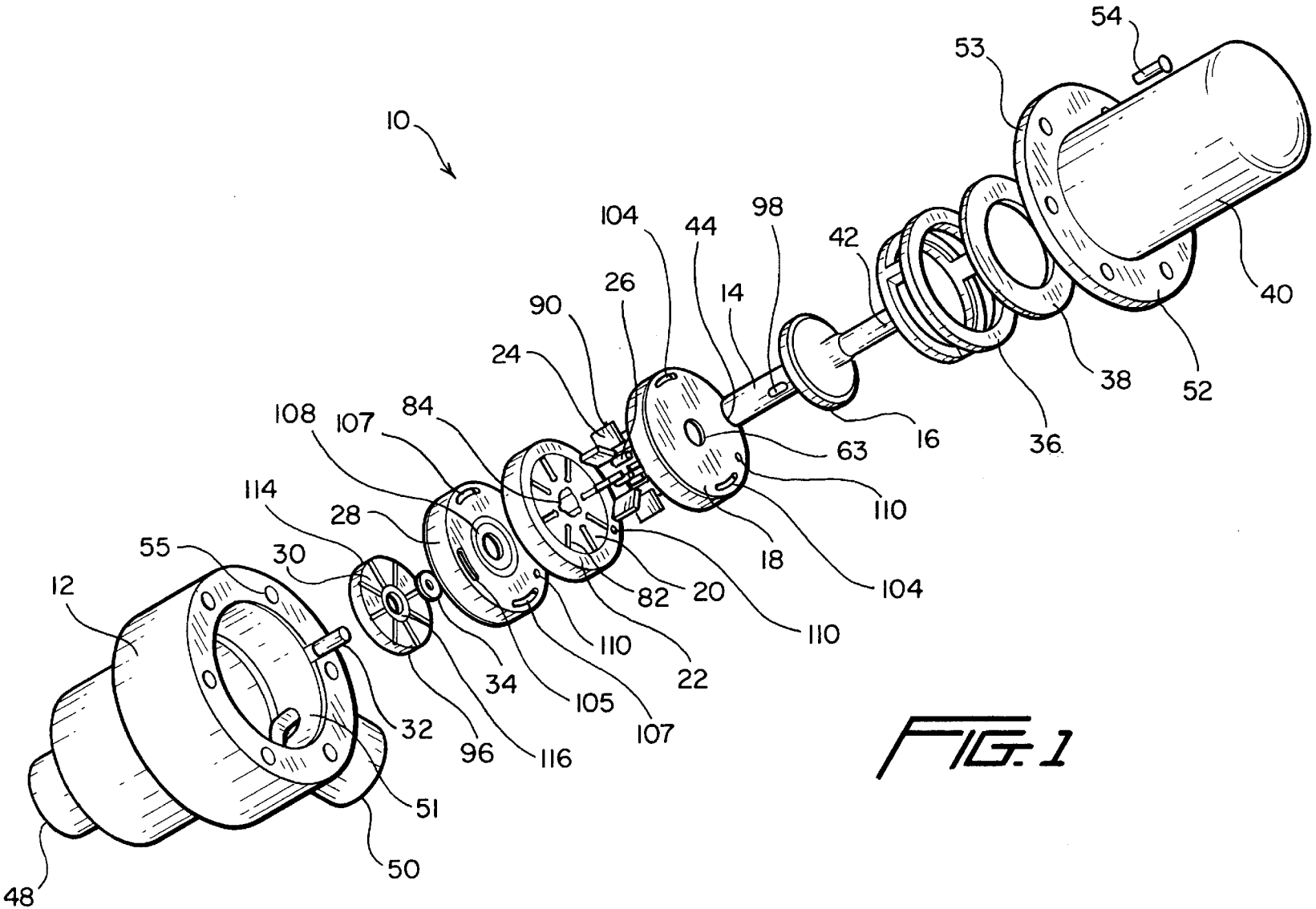
FIG. 1 is an exploded, perspective view of a pump according to various preferred embodiments of this invention.
Figure 6:
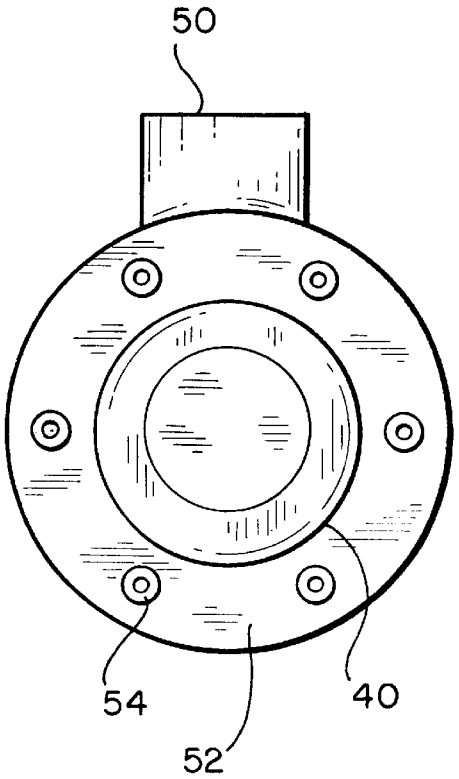
FIG. 6 is an end view of the impeller assembly of FIGS. 1 and 2.
Figure 2:
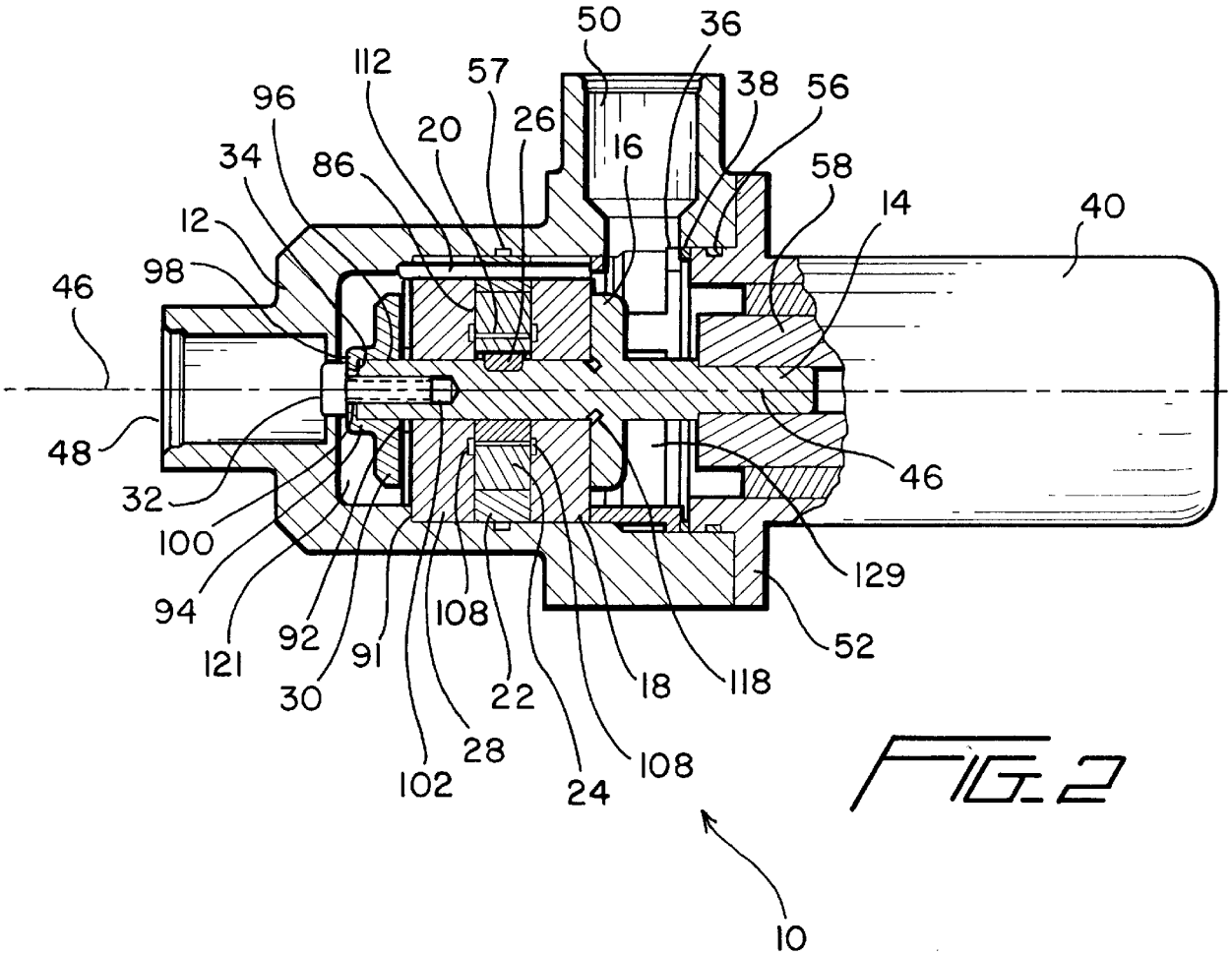
FIG. 2 is a partial cross-sectional view of the pump of FIG. 1.

Referring to FIGS. 1 and 2, pump 10 comprises a generally cylindrical housing 12 and an electric motor 40. A drive shaft 14 includes a first thrust plate 16 integral to its structure, and has a first end 42 and a second end 44. The first end 42 is in connection with the electric motor 40. The assembly also includes a spacer 36 and a wave spring 38, a first port plate 18, a rotor 20, a cam ring 22, vanes 24 including drive pins 26, a second port plate 28, a second thrust plate 30, a screw 32 and a shim washer 34. In the following description, any references pertaining to an axis will be understood to refer to an axis of rotation 46 of the drive shaft shown in FIG. 2, which axis is shared with the electric motor 40 and the housing 12.

The housing 12 has two ports, a first port 48 axially positioned at the distal end of the housing 12, and a second port 50 disposed orthogonally to the axis 46 of the housing 12. A feature of the pump of this invention is that it functions with comparable, and preferably equal, efficiency when pumping in either direction. Thus, when the pump is operating in one direction, port 48 serves as an inlet port and port 50 serves as an outlet port. When the pump is operating in the opposite direction, port 50 serves as an inlet port and port 48 serves as an outlet port. In the following description, for purposes of convenience, port 48 may be referred to as an inlet port and port 50 may be referred to as an outlet port, but it is understood that the inlet and outlet functions of the two ports are interchanged when the pump operating direction is reversed.

The end of the housing opposite the inlet port 48 has a circular opening 51, and this end of the housing is adapted for connection to the electric motor 40. For example, in the illustrated embodiment, flange 52 of motor 40 includes holes 53, and housing 12 includes corresponding threaded holes 55 in the surface surrounding opening 51, whereby the flange 52 is attached to the housing 12 by bolts 54. As seen in FIG. 2, a portion of the electric motor 40 that extends from flange 52 is received into the interior of housing 12 through opening 51, and this extending portion may be provided with a circumferential groove 56 for insertion of a seal, such as an O-ring, to provide an effective seal between the motor 40 and the housing 12.

Figure 3:
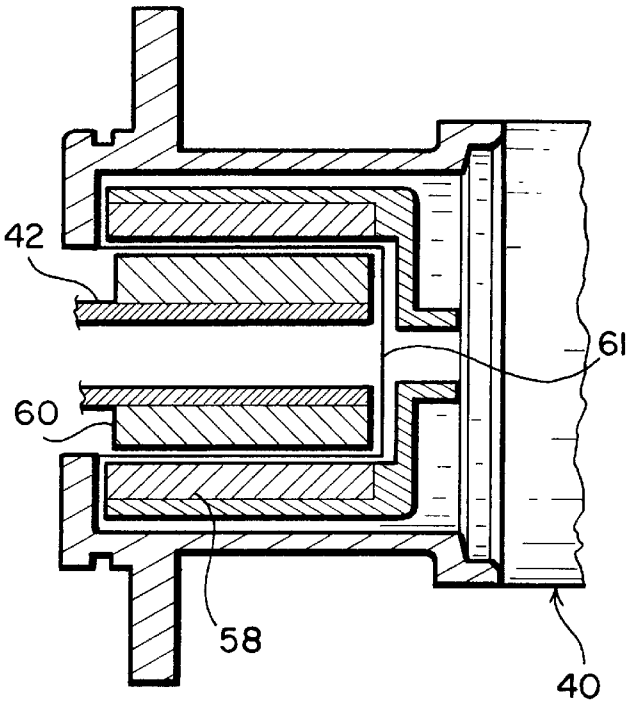
FIG. 3 is a cross-section of a coupling between the pump and a motor.

A detailed view of a magnetic coupling between motor 40 and the drive shaft of pump 10 is shown in FIG. 3. A cylindrical, axially aligned permanent drive magnet 58 in the motor 40 is magnetically coupled with a cylindrical mating driven magnet 60, which is mounted concentrically on end 42 of the drive shaft of pump 10, for example, magnet 60 may be affixed to end 42 with an adhesive. Thus, driven magnet 60 is disposed radially inward from, and axially aligned to, the drive magnet 58. Interposed between the drive magnet 58 and the driven magnet 60 is a cup-shaped fluid barrier 61 formed from a thin sheet of nonmagnetic corrosion resistant steel which permits magnetic forces to be transmitted between the magnets. This fluid barrier being integral to the motor housing, it completely seals the motor from the pump to prevent any liquid from passing into the motor. Magnet 60 is free to rotate when driven by magnet 58, neither magnet having contact with fluid barrier 61.

The first port plate 18 includes an axial opening 63 to rotatably accept the drive shaft 14, the second end 44 of which is inserted therein such that the first port plate 18 and the first thrust plate 16 are in close proximity. In the assembled pump, the spacer 36 is located between the motor 40 and the first port plate 18, the spacer having a large enough internal diameter to accommodate the first thrust plate 16 without interference. The wave spring 38 is interposed between the spacer 36 and the motor 40 in order to accommodate any slack in the assembly.

Figure 4:
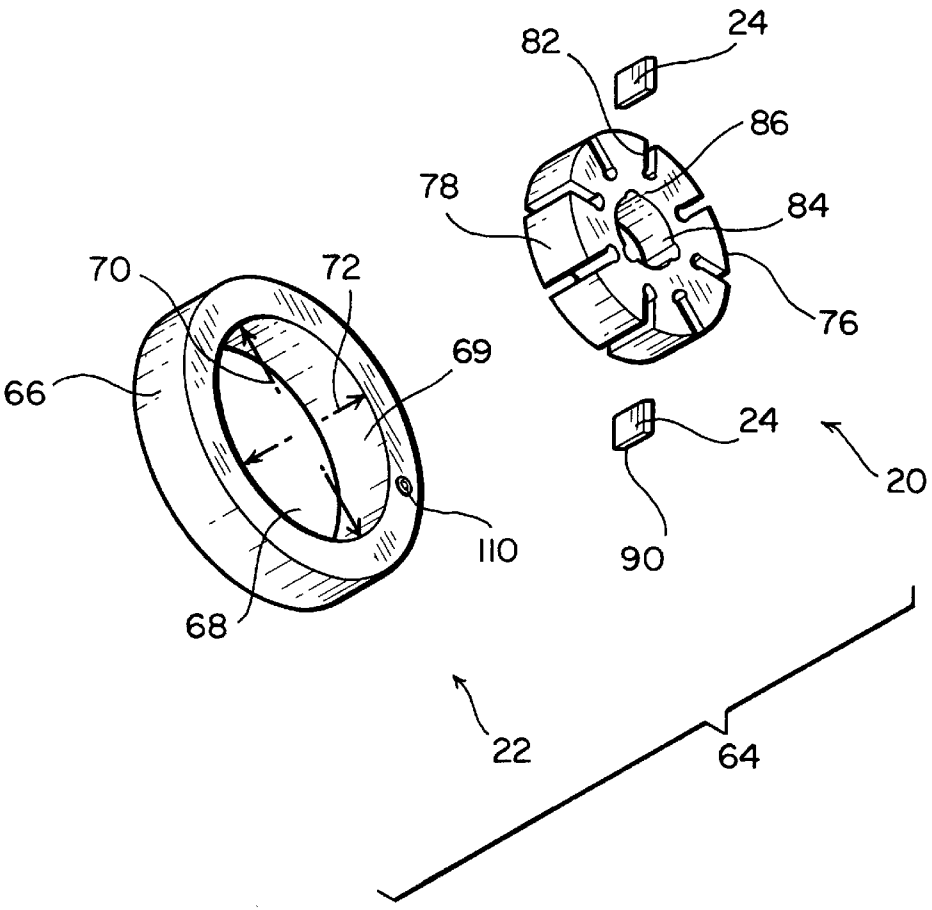
FIG. 4 is a partial perspective, exploded view of an impeller assembly comprising a cam ring, a rotor and vanes.
Figure 5:
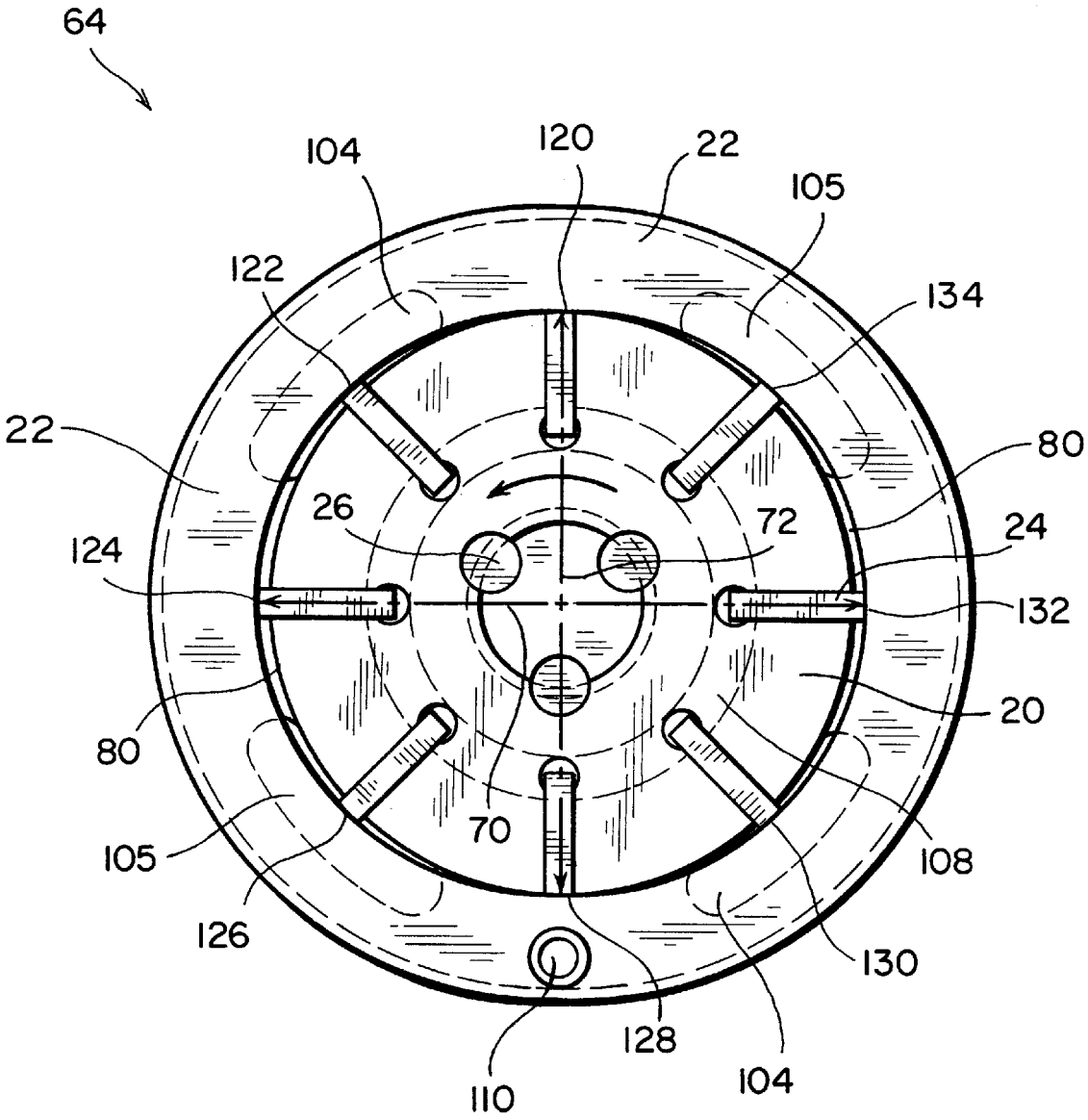
FIG. 5 is a schematic view of an impeller assembly of the pump.

Referring to FIGS. 4 and 5, an impeller assembly 64 comprises the rotor 20, the cam ring 22 and the vanes 24. The cam ring 22 has an outer cylindrical surface 66 in stationary contact with the inside surface of the housing 12, and an inner noncylindrical camming surface 69 that defines central opening 68. Specifically, the opening has an elliptical shape defined by a major diameter 70 and a different minor diameter 72, the two diameters offset from each other by 90°. The opening 68 is symmetrically disposed about, or concentric with, the axis 46. As seen in FIG. 2, the outer perimeter of the cam ring 22 may be provided with a circumferential groove 57 for insertion of a seal, such as an O-ring, to provide an effective seal between the cam ring 22 and the housing 12.

A rotor 20 is placed with the cam ring 22, the rotor having a circular perimeter 76 and an outer cylindrical surface 78. Rotor 20 is symmetrically disposed about the axis 46, such that rotor 20 is concentric with respect to the cam ring 22. The diameter of the rotor outer surface 78 approximates the minor diameter 72 of the cam inner surface. Accordingly, the insertion of the outer cylindrical surface 78 of the rotor within the elliptical camming surface of the cam ring 22 provides two diametrically opposed gaps 80 therebetween, the gaps arranged symmetrically with respect to one another about diameter 72.

As best seen in FIG. 4, outer surface 78 of the rotor 20 has a plurality of spaced radial slots 82 formed therein to accept vanes 24. The rotor 20 also has a central axial opening 84 and a plurality of smaller openings 86 around the periphery of the axial opening 84, these recesses being aligned with the axis 46 and sized to accommodate the drive pins 26. Disposed around a circumferential zone of the drive shaft are recesses 88 which correspond and align with the smaller openings 86 in the rotor 20 so that the drive pins 26 may be inserted into the openings 86 and recesses 88 to engage the drive shaft 14 with the rotor 20.

Inserted into the slots 82 are the vanes 24. Each of the vanes 24 is generally rectangularly shaped with a base and an arcuate outer end surface 90. Vanes 24 are free to translate within slots 82, such that when the rotor 20 revolves during the operation of the pump 10, centrifugal force maintains surfaces 90 of the vanes in sliding contact with the inner surface 69 of the cam ring 22. In other words, the cam ring remains stationary, and as the rotor rotates, the vanes are free to translate radially according to their position relative to the cam ring. It is noted that it is unnecessary for the vanes to be spring-biased according to the illustrated embodiment.

The impeller assembly 64 is positioned between the first port plate 18 and the second port plate 28, with the cam ring 22 remaining stationary with respect the port plates, and the rotor 20 rotating with respect to the port plates 18 and 28. The axial location of second port plate 28 is defined by a step 91 in the interior wall of the housing. As will be described further, the port plates 18 and 28, which are essentially identical in their geometry, differ in their orientation within the pump assembly.

The second thrust plate 30, which is mounted within the housing 12 at the same end of the housing as the inlet port 48, has an annular region 92, an extension 94 and an opening 96 sized to receive the second end 44 of the drive shaft 14. The opening 96 penetrates the entire thickness of the annular region 92 and into the extension 94, terminating at a cap 98. The cap 98 has an axial hole 100 sized to pass the screw 32, by which the second thrust plate 30 is fixedly bolted into a corresponding threaded hole 102 in the second end 44 of the drive shaft 14. A shim washer 34 is situated between the distal end 44 of the drive shaft and the inner shoulder of cap 98 of the second thrust plate. The second thrust plate 30 is in close proximity with the second port plate 28.

Referring further to the port plates 18 and 28, port plate 18 has two diametrically opposed reniform ports 104 through which fluid can pass, and port plate 28 similarly has two diametrically opposed reniform ports 105. Port plate 18 also has two diametrically opposed reniform recesses 106, and port plate 28 includes two similar recesses 107, which act as fluid reservoirs. The recesses 106 are staggered from the ports 104 by 90°, and the recesses 107 are staggered from the ports 105 by 90°. The ports 104, 105 and recesses 106, 107 are symmetrically positioned about the axis 46 in a circular band so that they straddle the gap 80 between the rotor 20 and the cam ring 22. Each such port 104, 105 and recess 106, 107 extends around an arc of about 45°. In addition to the reniform recesses 106, 107, each of the port plates 18 and 28 also has, facing the rotor, a circular recess 108 close to but not abutting the central opening. Besides their role in providing fluid channels and reservoirs, the port plates 18 and 28 also function as journal bearings for the drive shaft 14; the drive shaft is inserted directly in, and journaled by, the port plates requiring no anti-friction bearings. The thrust plates 16 and 30 are sufficiently smaller in diameter than the port plates 18 and 28, so that the thrust plates do not cover the ports 104, 105.

Considering their spatial relationship with the impeller assembly 64, the port plates 18 and 28 are disposed so that the recesses 106, 107 are on the faces of the port plates that abut the rotor. Further, the port plates are radially displaced from each other by 90° with respect to their ports 104, 105, and the ports 104 and 105 are radially equidistant from the major and minor diameters 70 and 72 of the cam ring 22 by 45°.

The cam ring 22 and port plates 18 and 28 have corresponding alignment holes 110 and are secured in place with an alignment pin 112 which is inserted in the alignment holes 110 and bolted into a threaded hole in the step 91 of the housing.

The second thrust plate 30 has a plurality of radial recesses 114 extending from its outer edge to meet with a circular recess 116 around the opening 96, the recesses being in the surface which abuts the second port plate 28. The first thrust plate 16 has like radial recesses meeting with a circular recess 118 where the first thrust plate meets the drive shaft 14, the recess 118 being shown in FIG. 2. The recesses of the first thrust plate 16 abut the first port plate 18.

A primary function of shim washer 34 is to control the amount of axial play in the entire assembly of components about the drive shaft 14. In effect, shim washer 34 determines the distance by which the thrust plates 16 and 30 are separated; the drive shaft 14 is allowed to float axially back and forth by a small but fixed distance, which allows for a film of fluid to be interposed between proximate faces of the port plates 18 and 28 and the thrust plates 16 and 30. The fluid film acts as a lubricant, which avoids the need to introduce a separate lubricating liquid which potentially may be a source of contamination. Generally, for a given lubricating action, generally, a fluid of low viscosity must be present as a thinner film than a fluid of higher viscosity. In other words, the lubricity of a fluid film tends to degrade more rapidly with increasing film thickness if the fluid has a lower viscosity. Therefore, by controlling axial play, the thickness of the fluid film may be controlled to provide a desired range of lubricity, thereby contributing to the efficiency of the pump.

The operation of the pump is dependent on the relationship of the port plates 18 and 28 to the impeller assembly 64. In the context of this invention, the term fluid will normally but not exclusively refer to a liquid, since a liquid would better fulfill the potential efficiency of the invention. Referring to FIG. 5, there is shown schematically the cam ring 22, the rotor 20 positioned within the cam ring, and the vanes 24. It will be seen that gaps 80 are present between inner surface 69 of the cam ring 22 and the outer surface 78 of the rotor, these gaps varying in width about the circumference of the rotor. As the rotor 20 rotates, each of the vanes 24 tends to be displaced outwardly from its respective slots 82 by centrifugal force, so that the outer surfaces 90 of the vanes slidingly contact the inner surface 74 of the cam ring 22.

FIG. 5 shows in outline the position of the ports 104, 105 in the first and second port plates 18 and 28, respectively. Although the rotor 20 may equally well be driven in either direction, the explanation which follows will assume that the rotation is counter-clockwise as viewed in FIG. 5. It will be seen that the ports 104, 105 of the first port plate 18 and the second port plate 28 are staggered by 90° when viewed along the axis 46.

Considering first in FIG. 5 the vane 24 in position 120, as the rotor rotates counter-clockwise, fluid is pushed ahead of this vane. Because of the widening gap between the rotor 20 and the cam ring 22, each given quantity of fluid is impelled into a larger volume than it previously occupied. Since the fluid does not expand to fill such additional volume, the additional volume is filled with incoming liquid, which enters through port 105 in the second port plate 28 from an inlet chamber 121. Considering now the vane in position 122, the volume is still increasing ahead of this vane as the rotor rotates counterclockwise, and the rotation of the vane in this position continues to cause the admission of fluid into gap 80. Position 124 is essentially a dwell point, where the available volume is at a maximum and therefore there is neither an increase nor decrease of fluid. Thus, the portion between positions 120 and 124 is a fluid inlet region. By contrast, from position 124 through 126 and up to position 128, there is a region of decreasing volume, from which an incompressible fluid is necessarily expelled through port 105 in the second port plate 28 into an outlet chamber 129. The position 128 has minimum available volume; just as with the region of maximum volume, the available volume neither increases nor decreases, whereby position 128 is essentially another dwell point. Thus, the portion between positions 124 and 128 is a fluid discharge region.

Once a given vane 24 passes position 128 it begins to repeat the pumping cycle in a fashion equivalent to position 120; similarly, positions 130, 132 and 134 are equivalent to positions 122, 124 and 126, respectively. In other words, for every revolution of the rotor, a given vane 24 goes through two pumping cycles. Therefore, there are two diametrically opposed inlet regions and two diametrically opposed discharge regions, the inlet and outlet regions being radially positioned at 90° from one another. The profile of the cam ring opening 68 is defined as a high power polynomial curve, which is selected to reduce both the acceleration and change in acceleration to zero at dwell points. This greatly reduces impact forces and therefore minimizes wear on the cam ring and vanes.

For the described counterclockwise rotation of the rotor, FIG. 5 shows the ports 104 of the first port plate 18 are lined up with the inlet regions, and the ports 105 of the second port plate 28 lined up with the discharge regions. The ports are sized and shaped to be most compatible with the flow rates at the regions of optimum inlet and discharge, providing the minimum possible constriction to flow and minimizing frictional energy losses. The use of radially opposed port plates results in a balance of forces on the rotor and thus promotes efficiency in operating the pump.

The housing, the drive shaft and the thrust plates are preferably made from stainless steel. Preferably, the drive shaft and the thrust plate are coated with a wear- and corrosion resistant coating, such as tungsten carbide. The vanes and cam ring are preferably made from tungsten carbide or other ceramic material, with tungsten carbide most preferred for the vanes because its high density provides greater centrifugal force than other ceramic materials, thus maintaining better contact with the cam ring. The rotor and the port plates are preferably made from a ceramic material exhibiting good wear resistance and corrosion resistance. The hardness and dimensional stability of an alumina ceramic renders it ideal for hydrodynamic journal bearings. The rotating drive shaft runs directly in the port plate journals; the inclusion of a wear resistant coating such as tungsten carbide on the drive shaft precludes the need for antifriction bearings. Additionally, the drive shaft and its thrust plate bear on the outboard faces of the port plates; such a coating serves to provide a hydrodynamic thrust bearing. Accordingly, the need to include antifriction bearings is eliminated, especially for applications of a water pump of relatively low pressure (i.e., no greater than 100 psi). Overall, the stability of the preferred materials provides resistance to the degradation of pump efficiency over long periods of time, thus reducing maintenance of the pump which is important for applications where the pump is installed in a remote location, such as in space.

It is clear that the pump 10 of this invention has a high degree of symmetry. In particular, if the revolution of the rotor 20 is reversed, the fluid flow patterns in the vicinity of the rotor 20 and port plates 18 and 28 are identical except in their direction. Such a reversal merely converts an inlet region to an outlet region and an outlet region to an inlet region, thus reversing the roles of the ports 104, 150 in the port plates 18 and 28, the inlet and outlet chambers 121 and 129, and the inlet and outlet ports 48 and 50 in the housing 12. The aforementioned symmetry mandates that the efficiency of the pump is independent of the direction in which it is operated. An exception to this symmetry is in the positioning of the inlet port 48 and outlet port 50 of the housing 12. Since the openings at these ports are much larger than the fluid clearances at other points in the system, they provide little resistance to flow by comparison, and will therefore have only a negligible effect on pump efficiency.

The arrangement of the various reniform recesses 106 and circular recesses in port plates 18 and 28, and of the radial recesses 114 in the thrust plates 16 and 30, is such that a film of the fluid being pumped is formed at the interfaces between the stationary port plates 18 and 28, and the rotating rotor 20 or thrust plates 16 and 30. This film acts as a lubricant which avoids the need to introduce a separate lubricating liquid which could be a source of contamination.

In summary, the combination of high internal symmetry, minimal constriction of fluid flow, control of play and inter-surface clearances, and low- corrosion, low-wear materials provides a long-life self-lubricating pump of high efficiency which operates equally well in either direction. Further, the ceramic material used for some components allows them to have a reduced weight by comparison with metal, which is important in space applications.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. A self-lubricating, bi-directional vane pump comprising:

a pump housing including a first port and a second port;

a reversible motor connected to a drive shaft such that the drive shaft is reversibly rotatable about its axis;

a stationary cam ring mounted in the pump housing, the cam ring having inner elliptical camming surface;

a rotor concentrically disposed within the cam ring and connected to the drive shaft to rotate therewith, the rotor having an outer cylindrical surface with radial slots therein, wherein the cam ring and the rotor are each concentrically aligned with the drive shaft axis, and the rotor is disposed in the cam ring such that two diametrically opposed, symmetrical gaps are present between the rotor outer surface and the cam ring camming surface;

a plurality of vanes slidingly disposed in the radial slots of the rotor, such that during operation of the pump, the vanes slide outwardly in the radial slots and maintain contact with the cam ring camming surface;

first and second port plates disposed in the housing on each side of the rotor and cam ring, wherein each of said port plates comprises:

two diametrically opposed ports, two diametrically opposed recesses formed in surfaces adjacent the rotor and cam ring, and a central opening on which the drive draft is journaled directly;

wherein said first and second port plates are arranged with respect to the cam ring such that the two diametrically opposed recesses of the first port plate are aligned with the two diametrically opposed ports of the second port plate, the two diametrically opposed recesses of the second port plate are aligned with the two diametrically opposed ports of the first port plate, and the two diametrically opposed ports of the first port plate are offset by 90° from the two diametrically opposed ports of the second port plate, the port plates being in fluid connection with the pump housing first and second ports, such that one of the pump housing ports functions as an inlet port when the pump is operated in a first direction, and the other of the pump housing ports functions as an outlet port when the pump is operated in a second direction, the pump operating with comparable efficiency in both directions; and wherein axial position of the drive shaft is controlled to permit a pumping fluid to lubricate component parts on which the drive shaft is journaled;

the pump further comprising a first thrust plate adjacent the first port plate, and a second thrust plate adjacent the second port plate, the first and second thrust plates being centrally attached to the drive shaft to rotate therewith and having diameter sized to avoid obstructing the ports in the first and second port plates, respectively.

2. The pump of claim 1, wherein the first thrust place is integrally formed with the drive shaft.

3. The pump of claim 1, wherein a surface of the first thrust plate adjacent the first port plate includes a plurality of radially disposed recesses connected to a circular recess surrounding its juncture with the drive shaft, and a surface of the second thrust plate adjacent the second port plate includes a plurality of radially disposed recesses connected to a circular recess around its juncture with the drive shaft.

4. The pump of claim 1, wherein a shim is interposed between an end of the drive shaft and an inner shoulder of the second thrust plate, said shim controlling axial movement of the drive shaft.

5. The pump of claim 4, wherein axial movement of the drive shaft is controlled to permit formation of a lubricating film of pumping fluid between surfaces of the port plates and adjacent surfaces of the port plates.

6. The pump of claim 5 wherein the pumping fluid has low viscosity.

* * * * *